US005216820A

United States Patent [19]

Green et al.

[11] Patent Number: 5,216,820

[45] Date of Patent: Jun. 8, 1993

[54] CURING UNIT AND METHOD OF CURING INK

[75] Inventors: Melvin E. Green, Evanston; Robert A. Green, Wilmette; Walter Sewielski, Harwood Heights, all of Ill.

[73] Assignee: M & R Printing Equipment, Inc., Glen Ellyn, Ill.

[21] Appl. No.: 765,141

[22] Filed: Sep. 25, 1991

[51] Int. Cl.[5] ..... F26B 3/34

[52] U.S. Cl. ..... 34/1 BB; 34/4; 34/13; 34/41

[58] Field of Search ..... 34/1 Y, 1 BB, 4, 39, 34/13, 16, 41, 18, 68, 1 Z

[56] References Cited

U.S. PATENT DOCUMENTS

| | | | |
|---|---|---|---|
| 3,733,709 | 5/1973 | Bassemir et al. | 34/1 AA |
| 3,894,343 | 7/1975 | Pray et al. | 34/1 AA |
| 4,222,177 | 9/1980 | Mason | 34/4 |
| 4,434,562 | 3/1984 | Bubley et al. | 34/4 |
| 4,485,565 | 12/1984 | Ertl et al. | 34/4 |
| 4,646,446 | 3/1987 | Bubley | 34/4 |
| 4,727,655 | 3/1988 | Jacobi, Jr. | 34/4 |
| 4,798,960 | 1/1989 | Keller et al. | 34/4 |

*Primary Examiner*—Henry A. Bennet
*Assistant Examiner*—Denise L. Gromada
*Attorney, Agent, or Firm*—Leydig, Voit & Mayer

[57] ABSTRACT

A curing unit and method for curing ink and the like on a substrate wherein the curing unit comprises a dual-chambered cover assembly in which is disposed a reflector assembly containing a curing lamp, and means for exhausting air from the chambers of the cover. The reflector assembly includes primary and secondary reflectors that reflect substantially all the radiation emitted along the upper portion of the lamp downward onto the substrate. The lamp is supported within the reflector assembly on upwardly opening supports that do not restrict the expansion or contraction of the lamp, and may be adjusted to adjust the focus of the lamp. The cover assembly includes inner and outer covers that create an outer cooling chamber therebetween, and an inner cooling chamber between the inner cooling chamber and the reflector assembly. The ends of the cover assembly form ducts which communicate with the means for exhausting air from the chambers of the cover. The exhaust means draws external cooling air into the outer cooling chamber through openings in the outer cover and exhausts the air to cool the unit. The exhaust means also exhausts heated air containing ozone, which rises from a curing chamber within the reflector assembly through a gap along an upper portion of the reflector assembly, from the inner cooling chamber to further cool the unit and the curing chamber in particular.

21 Claims, 6 Drawing Sheets

CURING UNIT AND METHOD OF CURING INK

FIELD OF THE INVENTION

The invention relates generally to a curing apparatus for use in screen process printing, and more particularly to an apparatus for curing photopolymerizable inks applied to flat and three-dimensional articles.

BACKGROUND OF THE INVENTION

Ultraviolet light sources have long been used for curing photopolymerizable inks on various substrates. However, most conventional types of curing systems develop a significant amount of heat and a build-up of ozone and certain evaporative volatiles in the reaction chamber during the curing operation.

Heat causes a number of problems, such as distortion of printed substrates and misregistration of multicolor. Excessive heat may also result in discoloration, shrinkage, or even blocking of more sensitive inks and substrates. These problems are aggravated when the upward movement of heated air within the curing chamber lifts lighter weight substrates upward within the chamber toward the lamp; fires may result, as well as reduced efficiency may result due to dirt on the lamp. Additionally, excessive heat captured in the curing chamber can greatly reduce the life of the lamp.

Ozone acts as a inhibitor to curing the ink itself. Ozone inhibits the chemical reaction required to polymerize and dry the ultraviolet curing ink. This improper cure can reduce the film strength and its adhesion to the printed substrate.

Numerous methods have been proposed for cooling ultraviolet curing units utilizing combinations of air and water cooling of the lamp itself. However, these types of cooling methods typically sacrifice energy output, and, characteristically, have high maintenance costs. Many ultraviolet curing systems include large housings that attempt to dissipate heat developed inside the reaction chamber. The housings generally include blowers that supply cooling air, which may be directed across the various components of the systems or the substrates themselves. For example, the apparatus disclosed in U.S. Pat. No. 4,434,562 to Bubley et al. includes a blower that produces a cooling air flow directed to the inner and outer surfaces of a reflector shield that houses an elongated curing lamp. While this type of design has been effective in supplying air to various components of the curing unit, it has not been effective for removing the heated air and ozone from the system. Further, it produces excessive air flow across the lamp, which diminishes the ultraviolet radiation output of the lamp.

OBJECTS OF THE INVENTION

It is a primary object of the invention to provide an ultraviolet ink curing unit that substantially decreases the length of time required to dry ink on a large array of substrates. A related object is to provide a curing unit that maximizes the amount of radiation provided under lower temperature conditions and decreases the level of ozone and other contaminants within the curing chamber.

Another object of the invention is to provide an ink curing unit that has a high productivity and repeatable ultraviolet ink drying operation.

A further object is to provide time and energy efficient drying of heat sensitive substrates.

An alternate object is to provide an ink curing unit that is safe and durable. A related object is to provide efficient exhaust of heat, ozone, and other volatiles from the drying chamber.

Another object is to provide a curing unit that is versatile in that it may be easily adjusted to accommodate various types of substrates. A more specific object is to provide a curing unit that includes a vacuum to hold lightweight sheets down. A related object is to provide a curing unit having a lamp that may be easily adjusted to provide a variable focus.

An additional object is to provide a curing unit that has low maintenance and may be easily serviced. A related object is to provide a curing unit having a lamp that may be easily cleaned and replaced.

Still another object is to provide a low cost unit that may be used to retrofit existing conveyorized dryers, so that existing conventional conveyorized dryers may be easily modified to provide combination drying capabilities.

SUMMARY OF THE INVENTION

In accomplishing these objectives, the invention provides a curing unit and a method for curing ink and the like on a substrate. The unit includes a lamp for providing radiation disposed within a curing chamber defined by a downwardly opening reflector assembly. The reflector assembly includes primary and secondary reflectors. The secondary reflector reflects radiation onto the primary reflector that is emitted along the upper portion of the lamp and would otherwise be reflected back downward onto the lamp. The primary reflector reflects onto the substrate radiation that has been emitted from the lamp into the primary reflector along with the radiation that has been reflected onto the surface of the primary reflector by the secondary reflector. The reflector assembly is disposed within a cover that has at least one opening in its outer surface and defines an outer chamber. The unit further includes means for exhausting heated air from the curing chamber, and means for drawing air through at least one opening provided in the cover into the outer chamber and exhausting the air from the outer chamber.

As the unit exhausts heated air created by the curing lamp from the curing chamber, the unit greatly reduces the temperature of the curing chamber and, consequently, the operating temperature of the curing system. The system is further cooled by the external cooling air that is drawn through the openings in the cover into the outer chamber and then exhausted from the chamber. This exhaust arrangement effectively cools the curing unit and provides cool running conditions. Additionally, the conveyor belt may be fabricated from an open mesh material and vacuum applied to hold lighter weight substrates to the belt. In this way, the curing unit significantly reduces the risk of substrate fires generally associated with ultraviolet curing units.

Further, the level of radiation emission may be increased in order to decrease drying time. As a result of the reduction of the required exposure time, the speed of a conveyor or the like, which passes the substrates beneath the lamp, may be increased, with a corresponding increase in productivity and decrease in temperature. Thus, the unit may be utilized to dry inks and coatings on a wide range of substrates, including heat sensitive substrates such as paper and plastic without burning, shrinking or distorting the substrate.

Additionally, as the unit exhausts the heated air from the curing chamber, heat is pulled away from the curing lamp, rather than directed at the lamp, as in the prior art. Consequently, the air flow within the curing chamber does not diminish the ultraviolet radiation output of the lamp, as in the prior art. Further, as the cooling arrangement greatly reduces the temperature within the curing chamber, it maintains the energy output of the ultraviolet lamp, which likewise increases the durability of the curing system.

Further, as the exhaust means draws heated air from the curing chamber, it likewise exhausts reaction-restricting ozone from the curing chamber. Consequently, the exhaust arrangement further decreases drying time by providing an environment in which the drying reaction may occur unincumbered by ozone or other volatiles.

Thus, it will be seen that the invention provides an arrangement that greatly increases the speed and effectiveness of ultraviolet ink-curing processes by exhausting heat and ozone from the curing unit and directing substantially all of the light emitted from the lamp onto the substrate. The inventive arrangement, therefore, greatly increases productivity, durability, and safety of ultraviolet ink curing processes.

These and other features and advantages of the invention will be more readily apparent upon reading the detailed description of a preferred embodiment of the invention and upon reference to the accompanying drawings wherein:

DETAILED DESCRIPTION OF THE PREFERRED EMBODIMENT

While the invention will be described in connection with certain preferred embodiments, it will be understood the there is no intention to limit the invention thereto, but rather to cover all modifications and alternatives included within the spirit and scope of the invention as defined by the appended claims.

Figure 1:
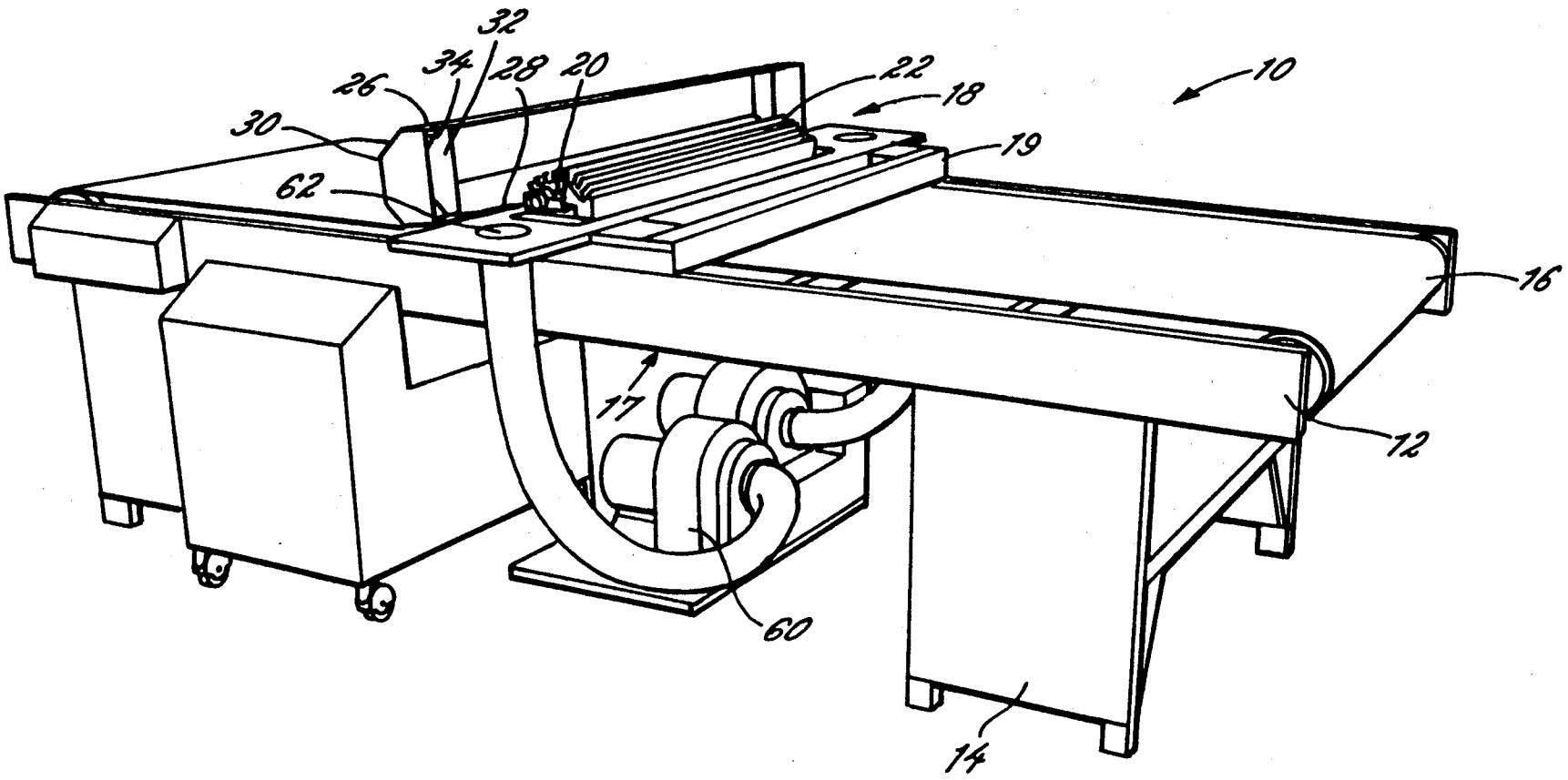
FIG. 1 is a perspective view of an ultraviolet curing system including an ultraviolet curing unit constructed in accordance with the invention and showing the cover assembly in an upright position.

Turning now to the drawings and referring first to FIG. 1, there is shown a perspective view of a system 10 for curing ink on a substrate (not shown) by the application of ultraviolet radiation. The system 10 includes a frame 12 supported on legs 14. A conventional continuous conveyor belt 16 supports and passes the substrate beneath a curing unit 18. The substrate may be held on the conveyor belt 16 by a vacuum from a suction unit 17 underlying the conveyor belt 16.

The curing unit 18 includes a base 19, which supports the unit 18 on the frame 12 above the conveyor belt 16. An elongated curing lamp 20 is supported within the unit 18 above the conveyor belt 16 and provides ultraviolet light to cure ink on the substrate. The lamp 20 may be a conventional ultraviolet lamp or tube, such as a mercury vapor tube. The lamp 20 is disposed within an elongated reflector assembly 22, which reflects radiation emitted by the lamp 2 downward onto the substrate through a curing chamber 24 (shown in FIGS. 4, 5*a*, and 5*b*) defined between the reflector assembly 22 and the conveyor belt 16.

The curing unit 18 further includes an elongated, generally inverted U-shaped cover assembly 26. In the unit 18 shown in FIG. 1, the cover assembly 26 is provided with a hinge 28 along one side so that the cover assembly may be pivoted open to the position shown. It will be appreciated, however, that during operation the cover assembly 26 is lowered over the reflector assembly 22 so as to define a cooling chamber therebetween.

In accordance with the invention, there is provided an improved curing unit 18 and method of curing ink on a substrate. The curing unit 18 is a unique design that operates at substantially low temperatures to cure ink on a substrate in a substantially cool environment. In order to provide an acceptable operating temperature within the curing unit 18, the unit provides a dual chamber cover assembly 26 and a unique reflector assembly 22, which facilitate removal of ozone and heated air from within the curing chamber 24 and dissipate heat from the reflector assembly 22 itself, while directing a maximum amount of ultraviolet energy downward toward the substrate. The unit 18 removes heat from the cooling and curing chambers 24 and provides a flow of cooling outside air, thereby maintaining components that normally retain heat at acceptable operating temperatures at all times. Further, the unit 18 removes ozone, which would otherwise inhibit the chemical drying action, from within the curing chamber 24. The removal of ozone, along with the reduction in the operating temperature within the curing chamber 24, substantially increases the intensity of curing ultraviolet radiation provided to the substrate and decreases the time required to cure the ink, with a corresponding increase in productivity. The design of the individual components and operation of the curing unit may be more fully understood by reference to FIGS. 2–5*b*.

Figure 2:
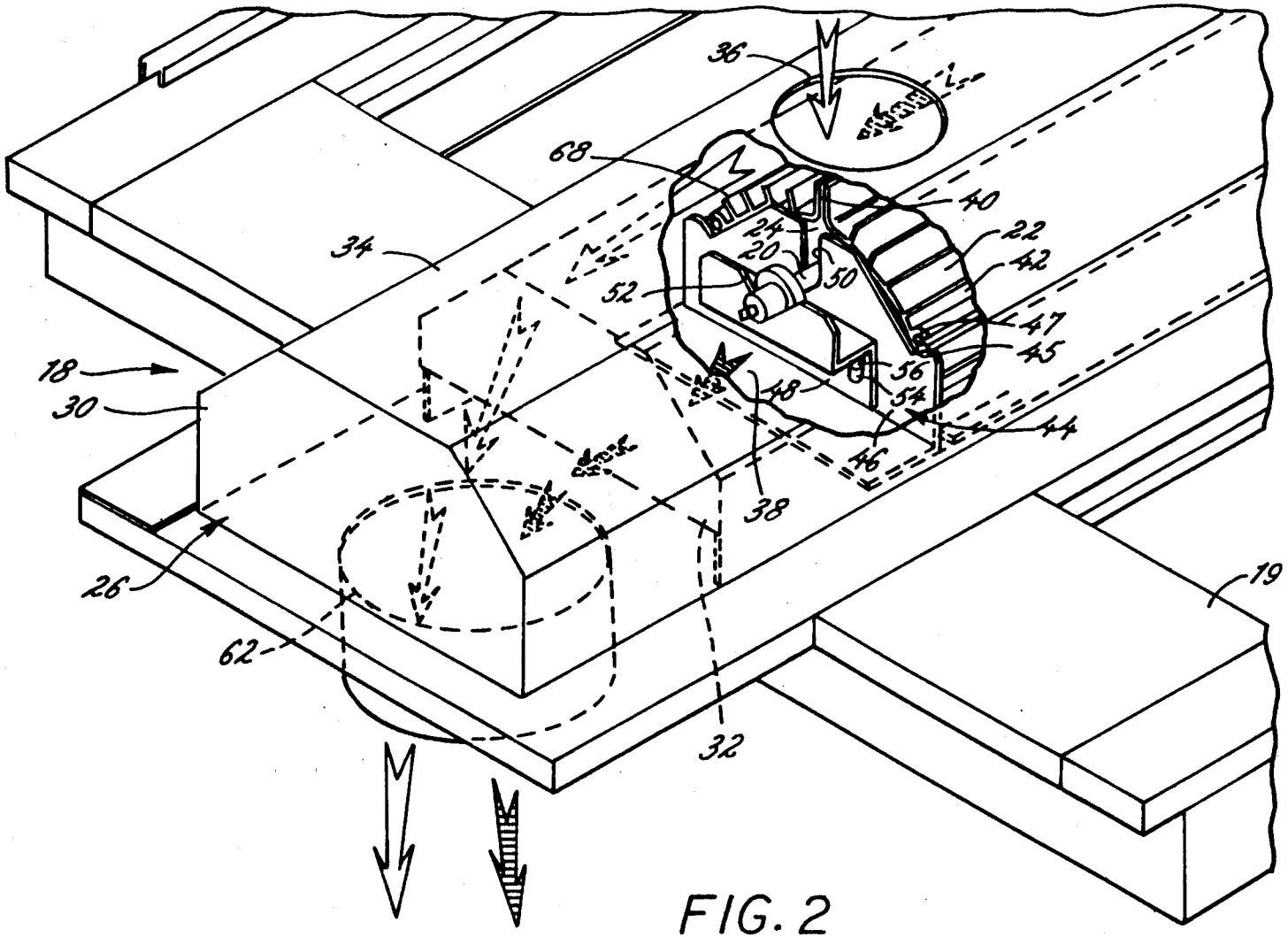
FIG. 2 is an enlarged fragmentary view of the ultraviolet curing unit of FIG. 1 with the cover assembly in a lowered position and partially cut away to show the underlying reflector assembly, and the adjustable positioning of the curing lamp.

Turning to FIG. 2, an enlarged fragmentary view of the ultraviolet curing unit 18 of FIG. 1 is shown with the cover assembly 26 in a lowered position. The cover assembly 26 includes an outer cover 30 and an inner cover 32 (shown in broken lines) disposed within the outer cover 30. In order to provide cooling outside air to an outer cooling chamber 34 formed between the outer and inner covers 30, 32, the outer cover 30 is provided with one or more openings 36. In the preferred design, three openings 36 are provided in the upper surface of the outer cover 30, but it will be appreciated that the cover may include any number of openings 36 disposed to provide sufficient cool air circulation around the inner cover 32.

The cover assembly 26 is shown partially broken away in FIG. 2 to illustrate the reflector assembly 22 disposed within the inner cover 32. An inner cooling chamber 38 is formed between the inner cover 32 and the reflector assembly 22. In order to provide a means by which heated air and other gases, such as ozone, and other volatiles, may be removed from the curing chamber 24, the reflector assembly 22 is formed with a gap 40 along its upper surface through which heated air and other gases may rise into the inner cooling chamber 38. The heated air and other gases are exhausted from the unit 18 by an exhaust system, which will be described in greater detail below. According to an important aspect of the invention, the gap 40 acts as a venturi as the heated air and gases flow through the gap 40. Thus, the gap 40 must be so dimensioned to cooperate with the exhaust system to provide an efficient flow of air from the curing chamber 24 through the gap 40 to be exhausted from the unit 18. It will be appreciated that there will be insufficient air flow if the gap 40 is too small, or air flow that is not uniform if the gap 40 is too large. In the preferred embodiment of the invention, the gap 40 is on the order of 1/16 of an inch wide.

Additionally, in the preferred embodiment, the reflector assembly 22 is formed in two elongated halves 42, coupled together at their ends, with the gap 40 extending the length of the reflector assembly 22 along its upper portion. It will be appreciated, however, that the reflector assembly 22 could be formed as a single unit with one or more gaps, openings, or the like formed along its upper portion. Alternately, the reflector assembly 22 could be formed of three or more elements with gaps formed therebetween to provide multiple openings through which heated air could escape the curing chamber 24.

In order to support the curing lamp 20 within the reflector assembly 22, lamp support assemblies 44 are provided at opposite ends of the reflector assembly 22. The reflector assembly 22 is coupled to the support assemblies 44 by pins 45, which are inserted into openings 47 that extend longitudinally along the outer surface of the reflector assembly 22. The lamp support assemblies 44 include end plates 46 and support brackets 48. It will be appreciated that the end plates 46 substantially cover the ends of the reflector assembly 22 to prevent the escape of ultraviolet radiation from the curing chamber 24.

The ends of the curing lamp 20 extend from the curing chamber 24 through elongated openings or slots 50 in the end plates 46, and are supported in V-slots 52 of the support brackets 48. In this way, the lamp 20 is self-centered in the reflector assembly 22. Those skilled in the art will also appreciate that the V-slots 52 allow the lamp 20 components to expand and contract without exerting undue forces of the lamp 20. Additionally, as the ends of the lamp 20 extend from the curing chamber 24, they are not directly exposed to ultraviolet light. The ends are further cooled by the flow of air as it is drawn and exhausted from the inner cooling chamber 38. In this way, the manner in which the lamp 20 is supported extends the life of the lamp 20 itself.

Further, the reflector assembly 22 may be removable to allow easy access to the lamp 20. The reflector assembly 22 may be formed as a single unit and hinged along one side or formed as two parallel components that pivot outward to allow access to the lamp 20. In the preferred embodiment, the sides of the reflector assembly 22 rest on pins. Thus, the reflector assembly 22 may be easily lifted to allow complete access to the lamp 20. Further, as the lamp 20 simply rests in the V-slots 52 and the elongated openings 50, it may be very easily replaced or serviced when the cover assembly 26 and reflector assembly 22 are removed.

In order to change the width of the output band of ultraviolet energy, and to accommodate various inks and substrates, the position of the lamp 20 within the reflector assembly 22 may be adjusted. It will be appreciated that the lamp 20 may be adjusted to a "downward" position within the reflector assembly 22 to provide a wider energy band; conversely, the lamp 20 may be adjusted to an "upward" position within the reflector assembly 22 to provide a narrower energy band. In order to adjust the position of the lamp 20, the support brackets 48, which support the lamp 20, may be adjusted upward or downward with respect to the end plates 46. While other designs may be suitable, in the exemplified embodiment, vertical slots 54 in the support brackets 48 are disposed on tightening screws 56 or the like on the end plates 46. In this way, the lamp 20 may be moved upward or downward within the curing chamber 24.

To maintain the curing unit 18 at a relatively low operating temperature, a system is provided for creating a negative pressure to exhaust air and ozone from the dual-chambered cover assembly 26. As shown in FIG. 1, one or more blower assemblies 60 are coupled to the curing unit 18 at one or more blower suction holes 62. In a preferred embodiment, the ends of the cover assembly 26 form a duct which cooperates with the blower suction holes 62 to define an air flow path; suction holes 62 are provided at both ends in order to equalize the vacuum. It will be appreciated, however, that different cover assembly 26 configurations and different exhaust means may be used to create a vacuum to expel air and ozone from the cover assembly 26.

Returning again to FIG. 2, it will be seen that operation of a blower assembly 60 draws cooling fresh air from the atmosphere surrounding the unit 18 into the outer cooling chamber 34 of the cover assembly 26 through the openings 36 in the outer cover 30, as indicated by the solid white arrows. Further, and as indicated by the cross-hatched arrows, operation of the blower assembly 60 draws ozone and heated air, which rise from the curing chamber 24 through the gap 40 in the reflector assembly 22, from the inner cooling chamber 38, the gap 40 acting as a venturi as air rushes therethrough. The blower assembly 60 then exhausts the cooling fresh air and the heated air, along with the ozone and other volatiles to the atmosphere.

Figure 3:
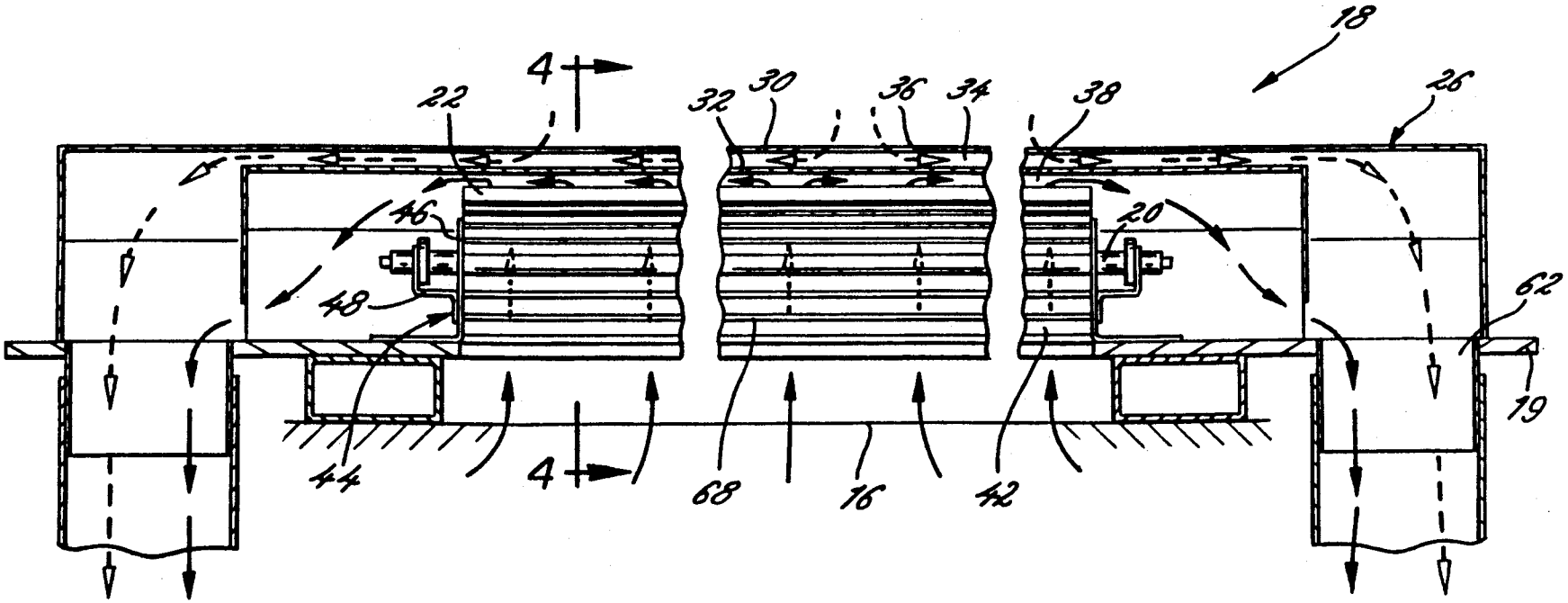
FIG. 3 is a cross-sectional view of the ultraviolet curing unit with the cover assembly in a lowered position and showing chambers and air paths for cooling and exhaust.
Figure 4:
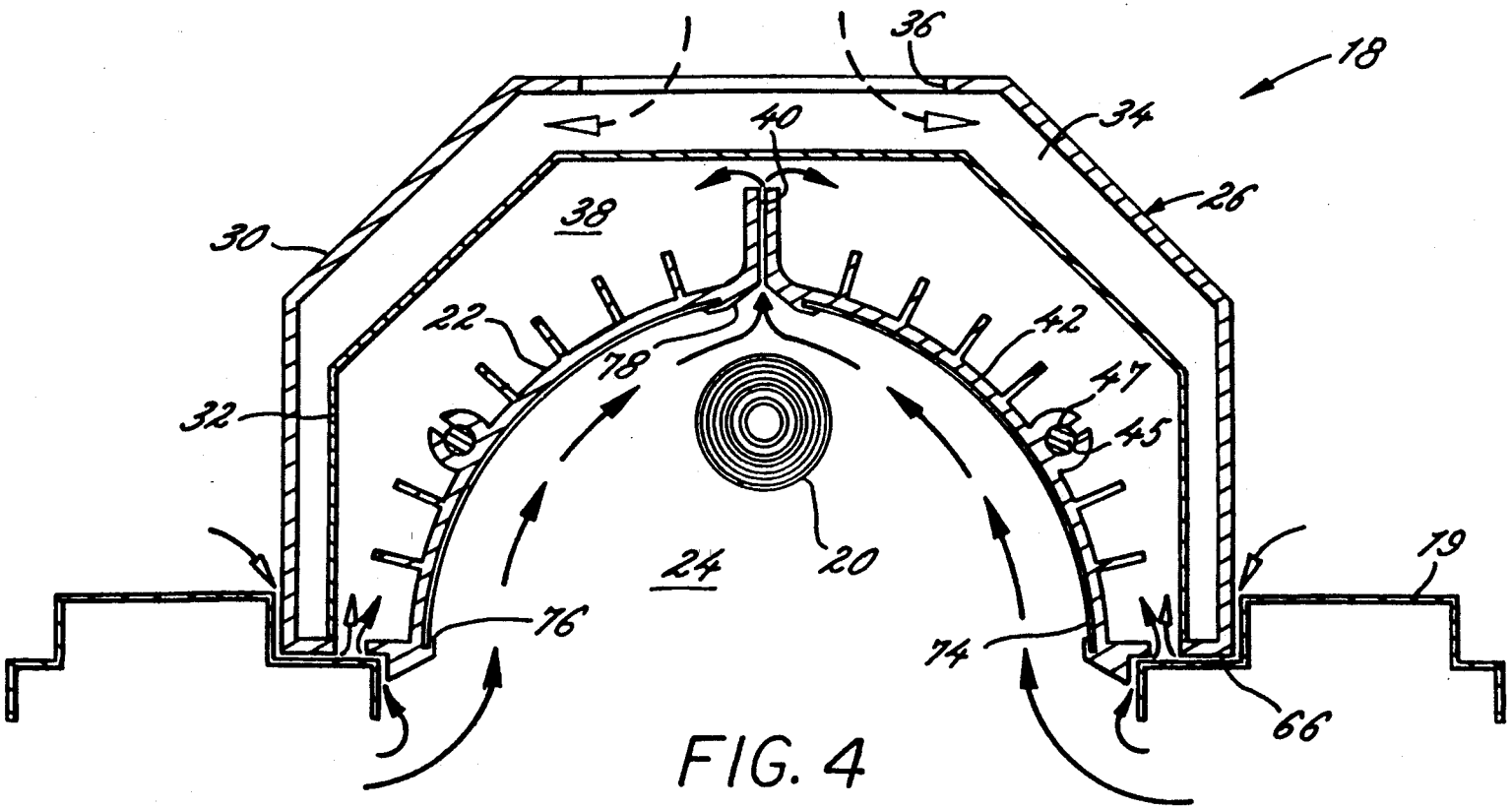
FIG. 4 is a cross-sectional view taken along line 4—4 in FIG. 3 of the ultraviolet curing unit with the cover assembly in a lowered position.

The operation of the negative pressure system for cooling the curing unit 18 may be more readily seen with reference to FIGS. 3 and 4, which show cross-sectional side and end views of the curing unit 18, respectively. Air flows through the outer and inner chambers 34, 38 are indicated by white and black arrows, respectively. It may be seen that the blower 60 pulls cooling fresh air into the outer chamber 34 through the openings 36, across the surfaces of the inner and outer covers 32, 30 to cool the components.

Similarly, the blower 60 pulls heated air and ozone from the curing chamber 24 into the inner cooling chamber 38 through the gap 40 disposed along the top of the reflector assembly 22, as well as through gaps 64 existing between the reflector assembly 22 and adjacent components of the curing unit 18 (as shown in FIG. 4). Thus, the cooling system does not blow cooling air directly across the inside surface of the reflector assembly 22 and the lamp 20, as in the prior art device disclosed in U.S. Pat. No. 4,434,562 to Bubley et al. In this way, the invention prevents excessive cooling of the lamp, which can diminish the ultraviolet energy output of the lamp.

The blower 60 may additionally pull cooling fresh air into the inner cooling chamber 38 through gaps 66 existing between the cover assembly 26 and the curing unit base 19 to provide a cooling air flow across the inner surface of the inner cover 32 and the outer surface of the reflector assembly 22 to cool the components. In a preferred embodiment of the invention, the reflector assembly 22 is extruded aluminum and includes a plurality of longitudinally extending cooling fins 68 disposed along its upper surface. Thus, as cooling air passes across the fins along the outside surface of the reflector assembly 22, the reflector assembly 22 will be efficiently and effectively cooled.

Figure 5A:
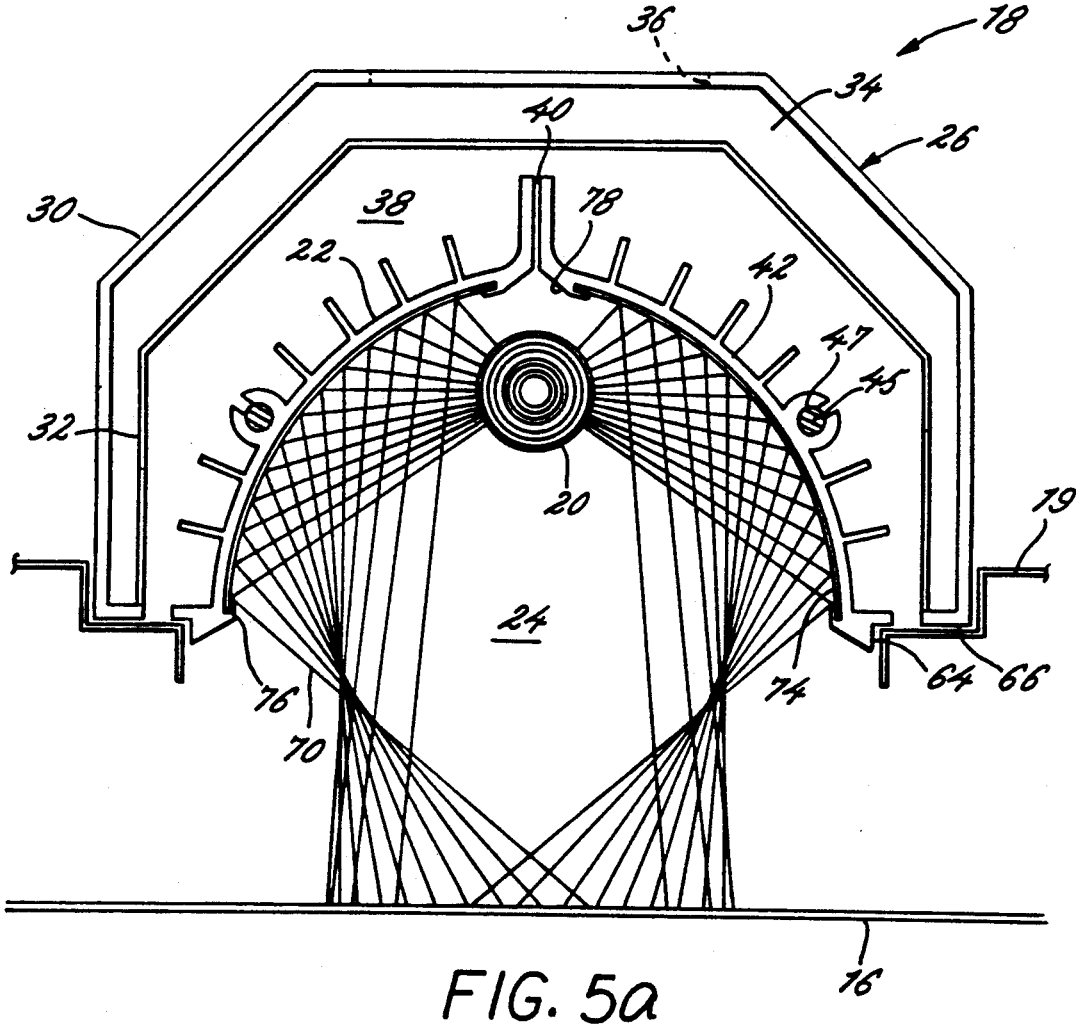
FIG. 5*a* is an end view of the curing unit as shown in FIG. 3 showing the concentration of the ultraviolet energy band reflected by the primary reflector assembly onto the substrate. The width of the band is adjustable by raising or lowering the lamp.
Figure 5B:
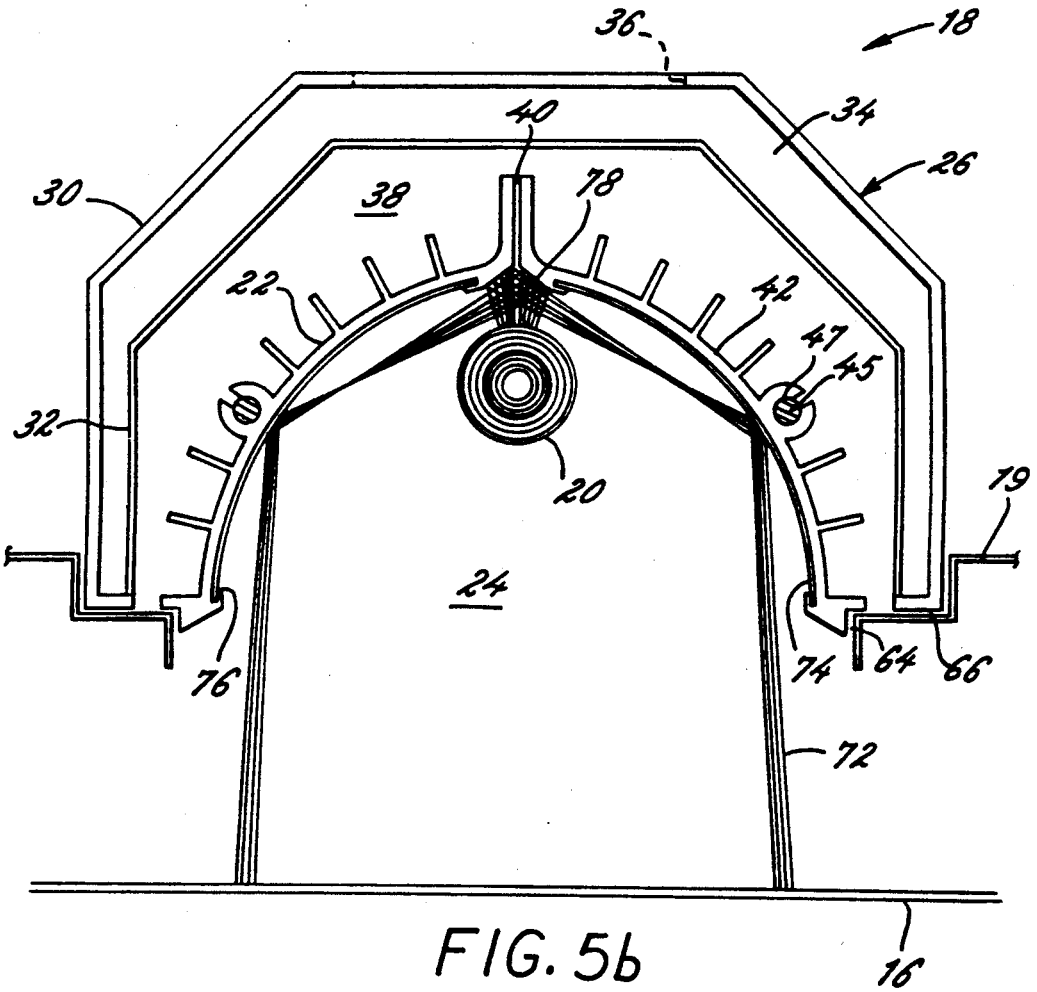
FIG. 5*b* is the same end view of the curing unit as in FIG. 5*a* showing the concentration of energy reflected by the secondary reflector onto the substrate instead of into the lamp.

In order to maximize the level of ultraviolet radiation provided to the substrate passing beneath the lamp 20, the reflector assembly 22 produces both primary and secondary reflections 70, 72, as shown in FIGS. 5*a* and 5*b*, respectively. The primary reflection 70 concentrates ultraviolet energy on the substrate as shown in FIG. 5*a*. It will be appreciated that the area over which the energy is focused may be adjusted by adjusting the lamp 20 up or down within the reflector assembly 22, as explained before. The primary reflection 70 is provided by a high polish primary reflector shield 74, which generally surrounds the curing lamp 20, substantially covering the inside surface of the reflector assembly 22. In the exemplified embodiment, the primary reflector shield 74 comprises portions disposed within each half 42 of the primary reflector assembly 22. The halves of the reflector shield 74 are disposed within longitudinally extending slots 76 in the reflector portions 42. In a preferred embodiment of the invention, the primary reflector shield 74 is fabricated from a highly polished material, such as Alzak or a similar material.

In order to provide an increased concentration of ultraviolet energy to the substrate, the reflector assembly 22 provides a secondary reflection 72, as shown in FIG. 5*b*. The secondary reflection 72 provides energy diverted from the blind spot above the lamp 20, which would otherwise be reflected back into the lamp 20 itself, to the primary reflector shield 74 to be focused on the substrate passing beneath the curing unit 18. Thus, it will be appreciated that the secondary reflection 72 also substantially reduces the temperature and extends the life of the lamp 20 by redirecting energy that would otherwise be reflected into the lamp 20.

In order to provide the secondary reflection 72, the reflector assembly 22 includes a secondary reflector 78 disposed along the blind spot of the reflector assembly 22 directly above the lamp 20. As shown in FIG. 5*b*, the secondary reflector 78 comprises angled surfaces that focus the energy emitted from the upper portion of the lamp 20 toward the primary reflector shield 74 and then downward to the substrate. It will be appreciated that when the angled surfaces of the secondary reflector 78 are disposed about the gap 40 formed between the reflector halves 42, the secondary reflector 78 also facilitates smooth flow of heated air from the curing chamber 24 to the inner cooling chamber 38. In a preferred embodiment of the invention, the secondary reflector 78 is fabricated as part of the extruded reflector halves 42.

As can be seen from the foregoing detailed description, the present invention provides a curing unit 18 and method for curing ink and the like on a substrate. The unit 18 includes a curing lamp 20 disposed within the curing chamber 24 of a reflector assembly 22, which includes primary and secondary reflectors 74, 78 that reflect downward toward a substrate substantially all of the radiation emitted by the lamp 20. The reflector assembly 22 is disposed within a dual-chamber cover 26 having an inner cover and an outer cover 32, 30 to define an outer cooling chamber 34 between the inner and outer covers 32, 30, and an inner cooling chamber 38 between the inner cover 32 and the reflector assembly 22. The unit 18 further includes means 60 for exhausting air from the chambers 34, 38. The exhausting means 60 draws external cooling air into the outer chamber 34 through openings 36 provided in the outer cover 30 to cool the unit 18. Further, the exhausting means 60 draws heated air containing ozone, which rises from the curing chamber 24 through a gap 40 in the reflector assembly 22, from the inner cooling chamber 38 to cool the curing chamber 24. In this way, the curing unit 18 maintains a cool curing environment and provides cool running conditions. Thus, the level of radiation emitted and the speed of the conveyor 16 may be increased with a corresponding increase in productivity without damage to the substrate.

What is claimed is:

1. A curing unit for curing ultraviolet reactive inks and other coatings on a substrate passed beneath the unit, comprising, in combination:

a lamp for providing radiation;

a downwardly opening reflector assembly, the lamp being disposed within the reflector assembly;

a curing chamber defined between the reflector assembly and the substrate;

means for exhausting heated air and ozone from the curing chamber;

a cover assembly having an outer surface with at least one opening therethrough, the reflector assembly being disposed within the cover assembly;

a cooling chamber defined between the cover assembly and the reflector assembly; and means for drawing air into the cooling chamber through the at least one opening and exhausting air from the cooling chamber.

2. The curing unit of claim 1, wherein the reflector assembly includes a gap through which heated air and ozone may escape, and the means for exhausting the heated air and ozone from the curing chamber also exhausts the heated air from the unit.

3. The curing unit of claim 1, wherein the cover assembly includes at least one end which forms a duct that communicates with the exhaust means and the drawing means.

4. The curing unit of claim 2, wherein the cover assembly includes at least one end which forms a duct that communicates with the exhaust means and the drawing means.

5. A curing unit for curing ultraviolet reactive inks and coatings on a substrate passed beneath the unit, comprising, in combination:

a lamp for providing radiation;

a downwardly opening reflector assembly, the lamp being disposed within the reflector assembly;

a curing chamber defined between the reflector assembly and the substrate;

a cover assembly having an outer surface with at least one opening therethrough, the reflector assembly being disposed within the cover assembly, the cover assembly comprising an outer cover and an inner cover, the inner cover being disposed between the outer cover and the reflector, and the outer cover including the outer surface;

a cooling chamber defined between the cover assembly and the reflector assembly, the cooling chamber comprising an outer cooling chamber and an inner cooling chamber, the outer cooling chamber being defined between the outer cover and the inner cover and the inner cooling chamber being defined between the inner cover and the reflector assembly;

means for exhausting heated air and ozone from the curing chamber and the inner cooling chamber; and means for drawing air into the outer cooling chamber through the at least one opening and exhausting air from the outer cooling chamber.

6. A curing unit for curing ultraviolet reactive inks and coatings on a substrate passed beneath the unit, comprising, in combination:

a lamp for providing radiation;

a downwardly opening reflector assembly, the lamp being disposed within the reflector assembly, the reflector assembly includes a gap through which heated air and ozone may escape;

a curing chamber defined between the reflector assembly and the substrate;

a cover assembly having an outer surface with at least one opening therethrough, the reflector assembly being disposed within the cover assembly, the cover assembly comprising an outer cover and an inner cover, the inner cover being disposed between the outer cover and the reflector assembly and the outer cover including the outer surface of the cover assembly;

a cooling chamber defined between the cover assembly and the reflector assembly, the cooling chamber comprising an outer cooling chamber and an inner cooling chamber, the outer cooling chamber being defined between the inner cover and the outer cover and the inner cooling chamber being defined between the inner cover and the reflector assembly, the heated air and ozone escaping from the curing chamber into the inner cooling chamber;

means for exhausting heated air and ozone from the curing chamber and the inner cooling chamber; and means for drawing air into the outer cooling chamber through the at least one opening and exhausting air from the outer cooling chamber.

7. The curing unit of claim 1, wherein the reflector assembly comprises a primary reflector and a secondary reflector disposed along the inside surface of the reflector assembly such that the secondary reflector reflects radiation emitted along a surface of the lamp substantially opposite the substrate onto the primary reflector and the primary reflector reflects radiation emitted by the lamp and radiation reflected by the secondary reflector onto the substrate.

8. The curing unit of claim 2, wherein the reflector assembly comprises a primary reflector and a secondary reflector disposed along the inside surface of the reflector assembly such that the secondary reflector reflects radiation emitted along a surface of the lamp substantially opposite the substrate onto the primary reflector and the primary reflector reflects radiation emitted by the lamp and radiation reflected by the secondary reflector onto the substrate.

9. The curing unit of claim 1 wherein the lamp is elongated and includes ends, and the unit further includes upwardly opening supports which support the ends of the lamp along their lower surfaces such that lamp is not restrained.

10. The curing unit of claim 1 further including supports which support the lamp within the reflector assembly, the supports being adjustable so that the position of the lamp within the reflector may be adjusted to adjust the focus of the lamp.

11. A curing unit for curing ink and other coatings on a substrate passed beneath the unit, comprising, in combination:

a lamp for providing radiation;

an inner cover;

a downwardly opening reflector assembly disposed within the inner cover to define an inner cooling chamber therebetween, the lamp being disposed within the reflector assembly, the reflector assembly having a gap through which heated air and ozone may escape from the reflector assembly into the inner cooling chamber; and means for exhausting the heated air from the inner cooling chamber.

12. The curing unit of claim 11, wherein the reflector assembly comprises a primary reflector and a secondary reflector disposed along the inside surface of the reflector assembly such that the secondary reflector reflects radiation emitted along a surface of the lamp substantially opposite the substrate onto the primary reflector and the primary reflector reflects radiation emitted by the lamp and radiation reflected by the secondary reflector onto the substrate.

13. The curing unit of claim 11 wherein the lamp is elongated and includes ends, and the unit further includes upwardly openings supported which support the ends of the lamp along their lower surfaces such that lamp is not restrained.

14. The curing unit of claim 11 further including supports which support the lamp within the reflector assembly, the supports being adjustable so that the position of the lamp within the reflector may be adjusted to adjust the focus of the lamp.

15. A method of curing ink and other coatings on a substrate in a curing unit having a curing lamp disposed in a downwardly opening reflector assembly for directing the radiation, and a cover, the reflector assembly being disposed within the cover, the method comprising the steps of:

passing the substrate beneath the lamp;

emitting radiation from the lamp and directing the radiation onto the substrate;

drawing cooling air through openings in the cover into a chamber between the cover and the reflector; and exhausting said drawn cooling air from the chamber.

16. A method of curing ink and other coatings on a substrate in a curing unit having a curing lamp disposed in a downwardly opening reflector assembly for directing the radiation, and a cover, the reflector assembly being disposed within the cover, the cover including an inner cover portion and an outer cover portion which create an outer chamber between the cover portions and an inner chamber between the inner cover and the reflector assembly, the method comprising the steps of:

passing the substrate beneath the lamp;

emitting radiation from the lamp and directing the radiation onto the substrate;

drawing cooling air through openings in the outer cover portion into the outer chamber; and exhausting air from the chamber.

17. The method of curing of claim 15, wherein the reflector assembly has a gap through which heated air and ozone may escape, and the exhausting step includes exhausting the heated air and ozone which escapes through the gap.

18. The method of curing of claim 16, wherein the reflector assembly has a gap through which heated air and ozone may escape into the inner chamber, and the exhausting step includes exhausting heated air and ozone from the inner chamber.

19. The method of curing of claim 15, further comprising the steps of supporting the substrate on a belt and drawing a vacuum on the substrate to hold the substrate onto the belt.

20. The method of curing of claim 15, wherein the reflector assembly comprises a primary reflector and a secondary reflector, and the directing step includes reflecting radiation emitted from a portion of the lamp substantially opposite the substrate toward the primary reflector by means of the secondary reflector, and reflecting radiation emitted from another portion of the lamp and radiation reflected from the secondary reflector onto the substrate by means of the primary reflector.

21. The method of curing of claim 15, wherein the cover includes at least one end which forms a duct, and the exhausting step includes exhausting air from the chamber through the duct.

* * * * *